US005927709A

United States Patent [19]

Greive

[11] Patent Number: 5,927,709

[45] **Date of Patent: *Jul. 27, 1999**

[54] DEVICE FOR TRANSPORTING SHEETS

[75] Inventor: Martin Greive, Heidelberg, Germany

[73] Assignee: Heidelberger Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/722,368

[22] Filed: Sep. 27, 1996

[30] Foreign Application Priority Data

Sep. 29, 1995 [DE] Germany ..... 195 36 358

[51] Int. Cl.[6] ..... B65H 29/70; B65H 31/00; B65H 1/00; B65H 5/16

[52] U.S. Cl. ..... 271/188; 271/209; 271/161; 271/272

[58] Field of Search ..... 271/188, 209, 271/161, 272, 3.14

[56] References Cited

U.S. PATENT DOCUMENTS

| | | | |
|---|---|---|---|
| 4,767,114 | 8/1988 | Nishimoto | 271/188 |
| 4,780,746 | 10/1988 | Naramore et al. . | |
| 5,029,842 | 7/1991 | Belanger et al. | 271/188 |
| 5,201,424 | 4/1993 | Hain | 271/188 |
| 5,209,466 | 5/1993 | Watts et al. | 271/188 |

FOREIGN PATENT DOCUMENTS

| | | | |
|---|---|---|---|
| 0 047 181 A2 | 3/1982 | European Pat. Off. . | |
| 0 230 313 A2 | 7/1987 | European Pat. Off. . | |
| 0 616 895 A2 | 9/1994 | European Pat. Off. . | |
| 1 761 077 | 4/1971 | Germany . | |
| 2 304 778 | 8/1973 | Germany . | |
| 24 60 796 | 6/1976 | Germany . | |
| 35 45 304 A1 | 7/1987 | Germany . | |
| 36 23 970 A1 | 1/1988 | Germany . | |
| 88 05 612 | 8/1988 | Germany . | |
| 41 35 539 A1 | 5/1992 | Germany . | |
| 0109357 | 6/1983 | Japan | 271/188 |
| 0006557 | 1/1985 | Japan | 271/188 |
| 60-106748 | 6/1985 | Japan . | |
| 63-185767 | 8/1988 | Japan . | |
| 0197267 | 8/1989 | Japan | 271/188 |
| 3-23153 | 1/1991 | Japan . | |
| 5-319657 | 12/1993 | Japan . | |
| 2020251 | 11/1979 | United Kingdom | 271/188 |
| 2 185 726 | 7/1987 | United Kingdom . | |

OTHER PUBLICATIONS

"Low Cost Stacking System", (Vipond et al.), vol. 8, No. 4, Jul./Aug. 1983.

"Feed Roller Separating Mechanism for Document Insertion", IBM Technical Disclosure Bulletin, vol. 33, No. 12, May 1991.

*Primary Examiner*—William E. Terrell
*Assistant Examiner*—Wonki Park
*Attorney, Agent, or Firm*—Herbert L. Lerner; Laurence A. Greenberg

[57] ABSTRACT

In a device for transporting sheets between a pair of transport rollers of a delivery of a printing machine, each of the rollers feature, along its respective length, several roller sections having greater diameters and roller sections having smaller diameters, with roller sections of one roller having greater diameters facing roller sections of the other roller having smaller diameters in order to provide the sheets, in longitudinal direction, with a transversely extending corrugated profile for the purpose of stiffening the sheets. Due to the fact that either roller sections of roller having greater diameters or roller sections with smaller diameters are mounted so as to be freely rotatable and that, when rotating the respective other roller, the roller sections are entrained by driven opposite roller sections of the respective other roller, all roller surfaces have the same speed so that the surfaces of the sheets are not damaged when being transported onto a delivery pile.

7 Claims, 3 Drawing Sheets

DEVICE FOR TRANSPORTING SHEETS

BACKGROUND OF THE INVENTION

FIELD OF THE INVENTION

The invention relates to a device transporting sheets between two parallel rollers, said rollers featuring, along their respective length, several roller sections some of which have greater diameters and some smaller ones, the roller sections of the one roller having greater diameters facing roller sections of the other roller having smaller diameters.

A device for transporting sheets is known, e.g., from copiers wherein a sheet is transported between rollers having a corrugated profile extending transversely to the sheet-transporting direction in order to move a respective sheet in a "flying" manner i.e. without guiding it or supporting its front area over a long distance onto a sheet pile.

The invention is directed to the problem caused with the known embodiments wherein the roller surfaces have different surface speeds, which may cause damage to delicate surfaces of the sheets being transported.

SUMMARY OF THE INVENTION

It is accordingly an object of the invention to provide a device for transporting sheets, which overcomes the hereinafore-mentioned disadvantages of the heretofore-known devices of this general type.

In a device according to the invention, this prioblem is solved in that with each roller either roller sections having greater diameters or roller sections having smaller diameters are mounted so as to be freely rotatable and so that, when rotating the respective rollers, the roller sections of one roller are entrained by the respective opposite roller sections of the other roller.

In this way it is prevented that any roller section of the rollers is in sliding frictional contact with the sheet to be transported.

In the preferred embodiment on one of the two rollers roller sections having a respective first diameter and roller sections having a respective second diameter alternate along the length of the respective roller, with the second diameter being smaller than the first one, and on the other roller roller sections having a respective third diameter and roller sections having a respective fourth diameter alternate, with the fourth diameter being greater than the third one. In order to produce an entraining effect the roller sections of the one roller having a respective first diameter and the roller sections of the other roller having a respective third diameter roll against each other in a pre-loaded or biased manner, and the roller sections of the one roller having a respective second diameter and the roller sections of the other roller having a respective fourth diameter roll against each other in a pre-loaded manner. The various roller sections of each roller are cylindrical elements, with the cylindrical elements being firmly connected to a continuous shaft alternating with cylindrical elements being mounted so as to be freely rotatable on the shaft. The two shafts are in synchronism with each other due to a gear maintaining the transmission ratio which corresponds to the ratio between the diameter of the cylindrical elements firmly connected to the one shaft and the diameter of the cylindrical elements firmly connected to the other shaft. That means that in this way only one of the two shafts has to be driven from the outside. The gear may simply consist of two interconnected gearwheels, one of said gearwheels being firmly connected to the one shaft, whereas the other is firmly connected to the other shaft.

At least one of two opposite roller sections is provided with an outer cylindrical surface made of rubber material i.e. flexible material which, in addition, features a high friction coefficient with respect to the surface of the opposite roller section. It is therefore achieved with simple means that the surface speed of all roller sections is always constant irrespective of the presence of a sheet between the rollers so that, when the sheet is being fed, there is no acceleration as a result of which the sheet could be abraded on the rollers.

As a pair of transport rollers the inventive device is suitable to be used as described above in the sheet delivery of a printing machine, especially a sheet-fed printing machine with a high sheet output as even at high conveying speeds no relative gliding motions occur between delivery rollers and sheets. Moreover, it is not necessary for the printing ink to be already completely abrasion-resistant the moment the sheet is being fed between the delivery rollers.

With the foregoing and other objects in view there is provided, in accordance with the invention, a device for transporting sheets between two parallel rollers, the rollers having along their respective length, several roller sections some of which have greater and some smaller diameters, with roller sections of the one roller having greater diameters facing roller sections of the other roller having smaller diameters, wherein the roller sections having greater diameters and the ones having smaller diameters of the respective rollers are mounted so as to be freely rotatable and so that, when rotating one of the rollers, respective roller sections are entrained by driven opposite roller sections of the respective other roller.

According to a further feature of the invention one of the two roller sections seen along its length has a first diameter alternating with roller sections having a second diameter which is smaller than the first diameter, and that, seen along its length, on the other roller sections having a respective third diameter alternating with roller sections having a respective fourth diameter which is greater than the respective third diameter, and wherein said roller sections of the one roller having a respective first diameter and the roller sections of the other roller have a respective third diameter rolling against each other in a pre-loaded manner, and wherein further the roller sections of the one roller having a respective second diameter and the roller sections of the other roller have a respective fourth diameter rolling against each other in a pre-loaded manner.

According to still another feature, each roller is provided with a shaft and several cylindrical elements forming the roller sections having different diameters and being alternatingly firmly connected to a respective shaft and mounted on a respective shaft so as to be freely rotatable, and wherein the two shafts are connected to each other via a gear the transmission ratio of which corresponds to the ratio between the diameter of said cylindrical elements firmly attached to the one shaft and the diameter of said cylindrical elements firmly attached to the other shaft.

According to a still further feature, the gear consists of two interconnected gearwheels, wherein one of the gearwheels is firmly connected to the one shaft and the other one being firmly connected to the other shaft.

According to an additional feature, at least one of two opposite roller sections of the roller features an outer cylindrical surface made of rubber material.

According to a concomitant feature, the two rollers form a pair of delivery rollers for a printing machine.

Other features which are considered as characteristic for the invention are set forth in the appended claims.

Although the invention is illustrated and described herein as embodied in a device for transporting sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
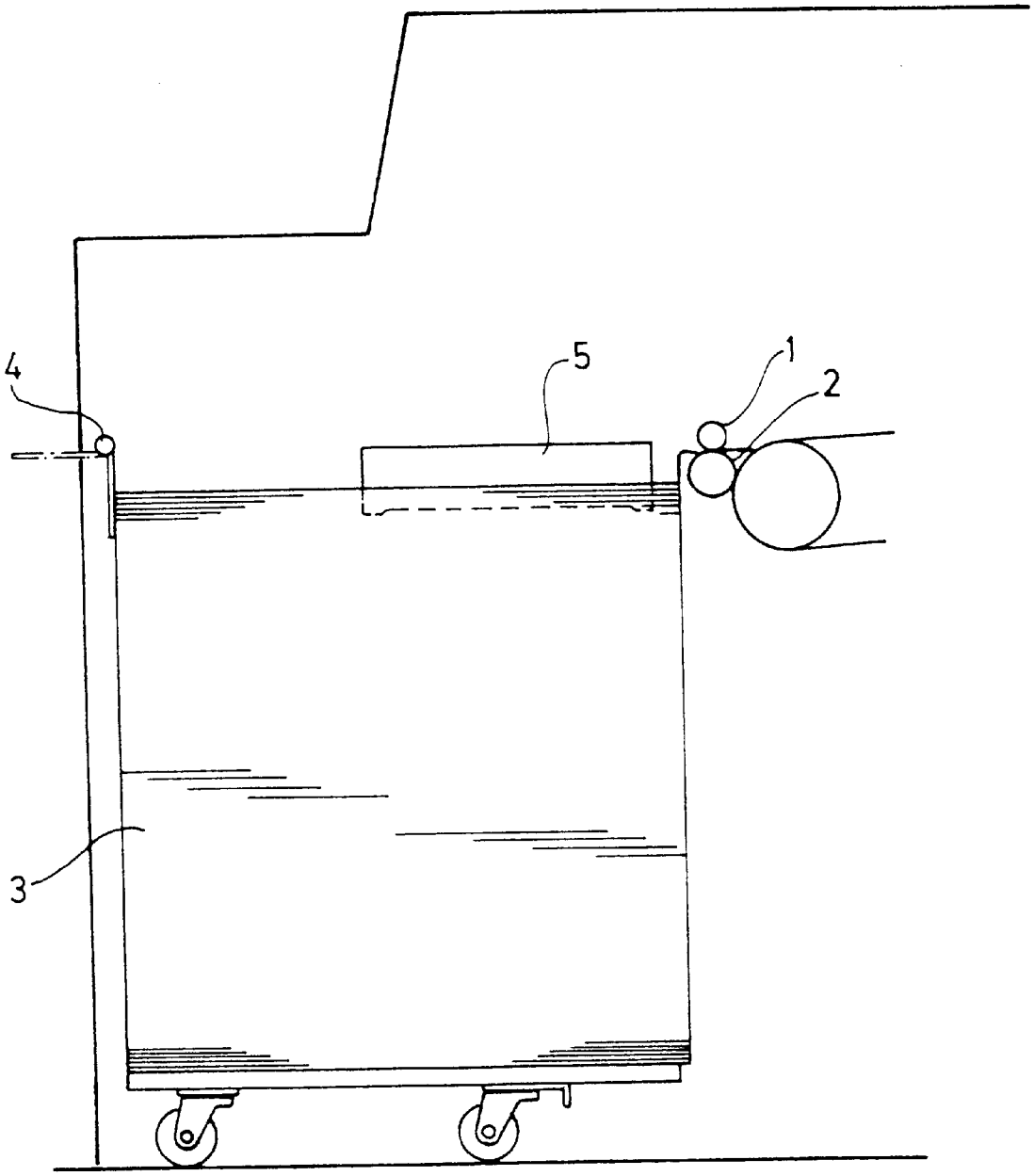
FIG. 1 is a side elevational view of a delivery of a sheet-fed printing machine.

Referring now to the figures of the drawings in detail and first, particularly, to FIG. 1 thereof, it is seen that in the delivery of a sheet-fed printing machine a non-illustrated sheet passes between two parallel transport rollers 1, 2 pushing it onto a delivery pile 3 where rear and lateral sheet stops 4, 5 ensure that a flush pile is formed. In so doing, the sheets have to be moved in a "flying" manner over a long distance, i.e. without being guided or without its front area being supported.

Figure 3:
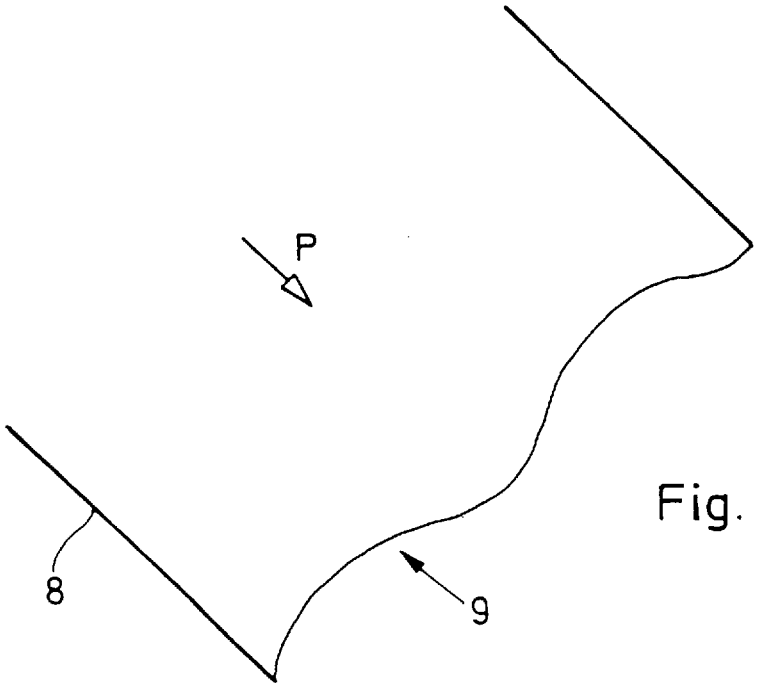
FIG. 3 is a sketch illustrating the stiffening of a sheet as a result of the corrugated profile.
Figure 4:
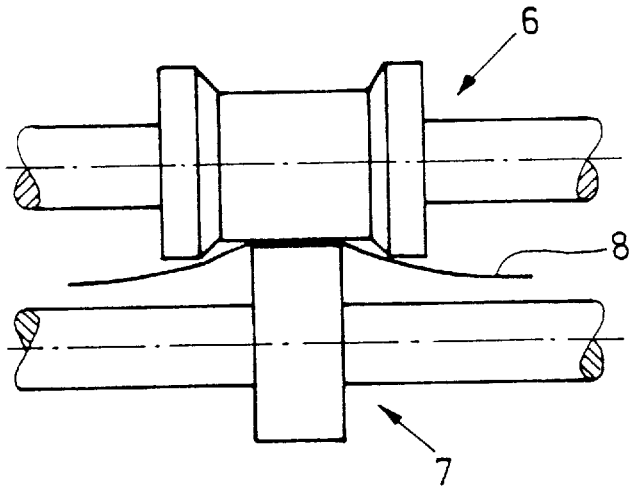
FIG. 4 shows a pair of transport rollers of the prior art for sheet stiffening.

In general, pairs of transport rollers having different diameters are used in copiers in order to prevent the leading sheet edge from being lowered and from curling. A segment of such a pair of transport rollers 6, 7 is shown in FIG. 4 in which there are roller sections having greater diameters and roller sections having smaller diameters, with roller sections having respective greater diameters on the transport roller 6 being opposite roller sections having respective smaller diameters the transport roll 7 and vice versa. As shown in FIG. 3, the transport rollers 6, 7 provide a sheet 8 with a corrugated profile 9, seen transversely to the sheet-transporting direction (indicated by arrow P). Said corrugated profile produces a very high degree of stiffness in sheet-transporting direction P, as a result of which the sheet 8 may "fly" freely over a long distance.

As the roller sections of the traditional transport rollers 6, 7 having different diameters are connected to each other so as to have fixed speed of rotation, they have different surface speeds.

Figure 2:
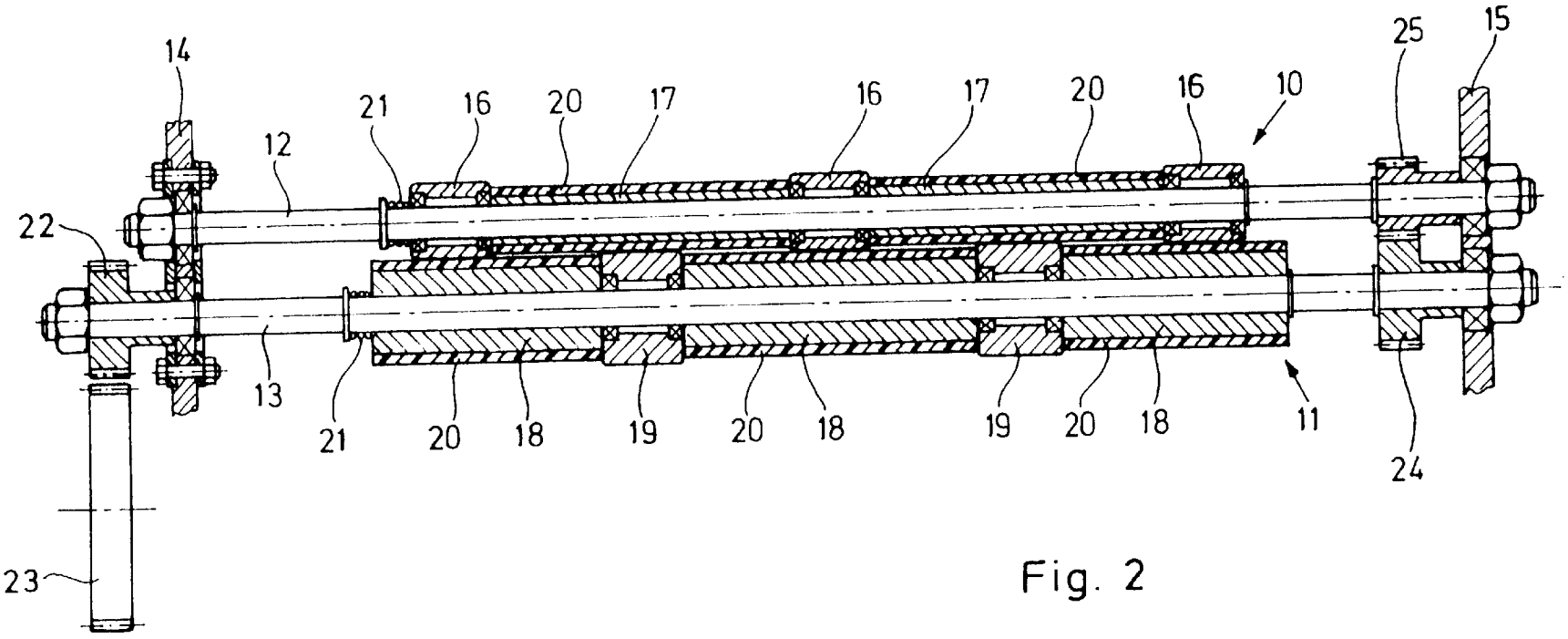
FIG. 2 is a sectional view, taken in longitudinal direction, of a pair of transport rollers used in the delivery of FIG. 1.

FIG. 2 shows a pair of transport rollers 10, 11 corresponding to the transport rollers 1, 2 of FIG. 1. Each transport roller 10, 11 features a shaft 12, 13, said shafts 12, 13 being mounted on side walls 14, 15 of a printing machine at a certain distance to each other so as to be rotatable and parallel to each other. Cylindrical roller sections 16 and cylindrical roller sections 17 are alternatingly slipped on shaft 12, seen along its length, with the diameters of roller sections 17 being somewhat smaller than the diameters of roller sections 16. Cylindrical roller sections 18 and cylindrical roller sections 19 are alternatingly slipped on shaft 13, seen along its length, with the diameters of roller sections 19 being somewhat greater than the diameters of roller sections 18. According to the distance between the shafts 12, 13 the different diameters are selected so that the circumferences of the cylindrical roller sections 16, 18 contact each other and so that the circumferences of the cylindrical roller sections 17, 19 contact each other.

Each cylindrical roller section 17, 18 is connected to the respective shaft 12, 13 so as to be fixed against rotation, and each cylindrical roller section 16, 19 is mounted on the respective shaft 12, 13, e.g., via ball bearings, so as to be freely rotatable on the shaft. Each cylindrical roller section 17, 18 which is fixed against rotation features an outer cylindrical surface in the form of a rubber coating 20 against which the cylindrical roller sections 16, 19 press. The cylindrical roller sections 16, 17 and 18, 19 are held together in axial direction of shaft 12, 13 by means of a respective spring 21.

A gearwheel 22 engaging in a drive gearwheel 23 of the printing machine is axially attached to one end of shaft 13, and a gearwheel 24 engaging a gearwheel 25 is fastened to the other end of shaft 13. The gearwheels 24, 25 have profiles which are offset with-respect to each other, and the rolling circle pitch is identical to the respective diameter of the cylindrical roller sections 17, 18 of shafts 12 13. In an alternative embodiment not shown the gearwheels 24, 25 may have smaller diameters than the cylindrical roller sections 17, 18, with the ratio of the diameter remaining the same, and may be connected to each other via a toothed belt and a gearwheel.

When the printing machine is in operation, the shaft 13 is rotated via the gearwheel 22 according to the machine speed, and the gearwheel 24 entrains the gearwheel 25 and thus the shaft 13. When shafts 12, 13 are rotated, the cylindrical roller sections 17, 18 provided with the rubber coatings 20 have the same surface speed, and so do the cylindrical roller sections 16, 19 which are always entrained by the cylindrical roller sections 17, 18. Thus, the circumferential speed is the same over the entire length of each of the transport rollers 10, 11, and a sheet being transported therebetween is given a corrugated profile as shown in FIG. 3, without risking that its surface is being damaged.

I claim:

1. A device for transporting sheets, comprising two mutually parallel, synchronously rotating shafts, two parallel rollers disposed thereon, each of said rollers having a length, each of said rollers having along said length several roller segments, some of said roller segments having relatively greater and relatively smaller diameters, said roller segments having greater diameters of each of said rollers axially aligned with corresponding roller segments having smaller diameters of a respective other of said rollers, some of said roller segments on each of said rollers being mounted so as to be freely rotatable and defining freely rotatable roller segments, others of said roller segments on each of said rollers being driven by being fixedly mounted on a respective one of said shafts and defining driven roller segments, said driven roller segments cooperating with said freely rotatable roller segments, and said roller segments having said greater diameters on each of said rollers entrained by said roller segments having said smaller diameters on a respective other of said rollers.

2. The device according to claim 1, wherein said roller segments which have relatively greater diameters are mounted so as to be freely rotatable.

3. The device according to claim 1, wherein said roller segments having relatively smaller diameters are rotatably driven.

4. The device according to claim 1, wherein each of said shafts further includes a gearwheel, said roller segments having relatively smaller diameters on a respective roller are connected to a respective said gearwheel for rotation thereof.

5. The device according to claim 1, wherein:

said roller segments having relatively greater and relatively smaller diameters along a length of one of said parallel rollers define a plurality of respective first and second diameter segments, said plurality of first diameter segments having a substantially equal diameter, said plurality of second diameter segments having a substantially equal diameter, said first and second diameter segments are alternatingly disposed along said length of said one of said parallel rollers;

said roller segments having relatively greater and relatively smaller diameters along a length of another one of said parallel rollers define a plurality of respective third and fourth diameter segments, said plurality of third diameter segments having a substantially equal diameter, said plurality of fourth diameter segments having a substantially equal diameter, said third and fourth diameter segments are alternatingly disposed along said length of said other one of said parallel rollers;

said first and said fourth diameter segments are mounted to roll against each other in a pre-loaded manner; and said second and said third diameter segments are mounted to roll against each other in a pre-loaded manner.

6. The device according to claim 5, wherein each of said shafts includes a gearwheel, said first and third diameter segments are rigidly connected to a respective shaft, said gearwheels connect said shafts and have a transmission ratio equal to a ratio between said diameters of said first and third diameter segments.

7. The device according to claim 1, wherein at least one of said axially aligned roller segments includes an outer cylindrical surface made of a rubber material.

* * * * *